US006431417B1

(12) United States Patent
Kumar

(10) Patent No.: US 6,431,417 B1
(45) Date of Patent: Aug. 13, 2002

(54) SPOUT OR LIP FOR POURING LIQUID

(76) Inventor: Damini Kumar, Sushil Cottage, Chandlers Hill, Iver Heath, Iver, Buckinghamshire SL0 0EA (GB)

( * ) Notice: Subject to any disclaimer, the term of this patent is extended or adjusted under 35 U.S.C. 154(b) by 0 days.

(21) Appl. No.: 09/806,014

(22) PCT Filed: Sep. 27, 1999

(86) PCT No.: PCT/GB99/03212

§ 371 (c)(1),
(2), (4) Date: Mar. 26, 2001

(87) PCT Pub. No.: WO00/18276

PCT Pub. Date: Apr. 6, 2000

(30) Foreign Application Priority Data

Sep. 26, 1998 (GB) ..... 9820925

(51) Int. Cl.[7] ..... B65D 5/72

(52) U.S. Cl. ..... 222/571; D23/212

(58) Field of Search ..... 222/111, 564, 222/566, 567, 571, 572, 573, 574; D23/212

(56) References Cited

U.S. PATENT DOCUMENTS

| | | | | | |
|---|---|---|---|---|---|
| 573,759 | A | * | 12/1896 | Brown | 222/111 |
| 1,357,629 | A | * | 11/1920 | Faistl et al. | 222/572 |
| 1,416,309 | A | * | 5/1922 | Tunnicliff | 222/571 |
| 5,169,040 | A | * | 12/1992 | Wiley | 222/571 |
| 5,228,596 | A | * | 7/1993 | McNally | 222/571 |

* cited by examiner

*Primary Examiner*—William C. Doerrler
*Assistant Examiner*—Thach H. Bui
(74) *Attorney, Agent, or Firm*—Breiner & Breiner, L.L.C.

(57) ABSTRACT

A spout or pouring lip having a subsidiary lip arranged transversely across the spout or pouring lip below the pouring edge. The subsidiary lip is formed from the edge of a groove, notch or indentation arranged transversely below the pouring lip. The face of the groove, notch or indentation nearer the pouring lip is arranged to be substantially vertical. The inner surface of the spout or pouring lip may in addition be constructed to form a raised transverse fence-like form. The invention may be an integral part of a pouring vessel such as a teapot, jug, kettle or pouring can or it may form an additional component as attached, either during the vessel's manufacture or as an addition to an existing pouring vessel.

19 Claims, 1 Drawing Sheet

SPOUT OR LIP FOR POURING LIQUID

TECHNICAL FIELD

This invention relates to improvements to spouts and pouring lips as used typically on products such as teapots, jugs, kettles and pouring cans. This is not an inclusive list, and the improvements may be included within any product used for pouring fluid. The purpose of the invention is to improve the flow and produce a spout or pouring lip that produces only minimal dripping.

BACKGROUND ART

It is well known that for good pouring and for minimal dripping on a spout or pouring lip the exit form should have a sharp edge. However, with many products it is definable from an aesthetic and/or a hygiene point of view that they are formed from materials such as ceramics or other materials that are glass-coated or glazed. With these materials in particular it is difficult if not impossible to provide the desirable sharp lipping, particularly in production.

SUMMARY OF THE INVENTION

We have appreciated that improvements to spouts and lips can be made. In particular, we have appreciated that dripping from spouts and lips can be reduced, and that if drips occur, the annoyance of these running down an outer surface of the pouring vessel can also be reduced. The problem of dripping is particularly noted for table vessels such as teapots.

An aspect the invention provides a spout or pouring lip incorporating a subsidiary lip below the main pouring lip or edge. The advantage of the subsidiary lip is that drips from the main pouring lip or edge are reduced. This is achieved by guiding drips on an outer surface to fall into a vessel to which liquid is poured and preventing further drips falling from the spout or lip. Moreover, dripping from the main lip is reduced by terminating the flow of liquid before the main lip.

In a first aspect, there is provided a spout or lip for pouring a liquid terminating in a pouring lip having an inner surface and an outer surface, the inner surface being suitable for pouring a liquid and having an inner protrusion protruding therefrom so arranged to terminate liquid flow when tilting the spout or lip after pouring a liquid.

The protrusion on the inner surface thus terminates liquid flow prior to the pouring lip, thereby reducing drips found at the lip.

Preferably, the inner protrusion is arranged close to the pouring lip of the spout or lip, and preferably has a fence or ridge like structure. This provides termination of the liquid flow at the appropriate point.

In a second aspect, there is provided a spout or lip for pouring liquid having an inner surface and an outer surface, terminating in a pouring lip, the inner surface being suitable for pouring a liquid the outer surface having an outer protrusion so arranged that a liquid flowing from the pouring lip along the outer surface does not pass beyond the outer protrusion.

The outer protrusion serves the function of guiding any drops on the outer surface into the vessel to which liquid is poured. Liquid does not pass along the outer surface past the outer protrusion. In addition, the last remaining drip clings to the protrusion by surface tension. Accordingly, the outer protrusion is preferably a downward facing point, and is preferably near the lip so that any drips falling from the protrusion do fall to the vessel.

The invention can reside in a combination of the first and second aspects. In an embodiment of such a combination, the inner and outer protrusion comprise a single step in the inner and outer surfaces.

BRIEF DESCRIPTION OF DRAWINGS

An embodiment of the invention will now be described, by way of example only, and with reference to the figures in which.

DESCRIPTION OF AN EMBODIMENT

Figure 1:
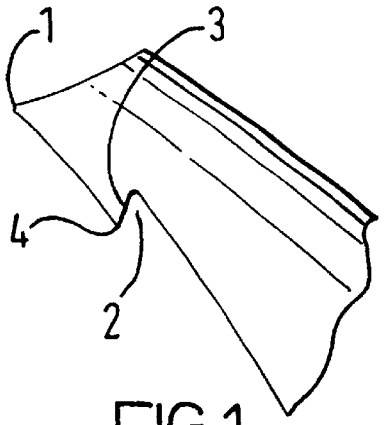
FIG. 1 is a view of an outer surface of a spout embodying the invention.

The embodiment shown in FIGS. 1 to 4, is a spout, although an embodiment could be a lip which is not enclosed. The spout shown has a lip 1 an inner surface 8, 10 and an outer surface 9. The inner surface includes an inner protrusion 5, and the outer surface includes an outer protrusion 4. As shown the inner protrusion 5 and outer protrusion 4 comprise a single step. The inner surface is thereby divided into a first inner surface portion 8, and a second inner surface portion 10.

The embodiment has an outer protrusion defining a groove, notch or indentation arranged transversely across the spout or pouring lip below the pouring edge. The edge of the groove nearer the spout or pouring lip edge is preferably manufactured with as sharp an edge as is reasonably possible in the material forming process and that side of the groove or notch is preferably manufactured to be vertical or substantially so. This edge may be regarded as or described as a subsidiary lip. The inner vessel face in the spout or lip area of the product may also benefit from the raised fence-like form of the groove or notch, producing improved flow and cut off when pouring.

A similar effect may be produced by an additional component applied to the outside of a spout or pouring lip to produce a subsidiary lip in a similar position to the edge of the groove, notch or indentation as described in the embodiment above. In this embodiment of the invention the additional component may be permanently attached to the pouring vessel or may be a detachable component or an addition to an existing spout or pouring lip. The invention may also be incorporated into an additional component in order to convert a vessel not originally designed specifically for pouring liquids into one equipped with a pouring lip.

A preferred embodiment of the invention also includes a lip or spout raised above the normal maximum level of fluid in the product when the product is horizontal. This rise should be at least 5 mm in order to achieve significant benefits in pouring and reduction of surge in the fluid when poured.

The figures illustrate the invention as applied to a teapot, but it could equally be applied to a kettle, jug or other vessel or product used for pouring fluids.

FIG. 1 shows a side elevation of a teapot spout incorporating the invention. The pouring lip of the spout 1 is formed as sharply as possible by the manufacturing process. Below the pouring lip a transverse groove 2 is incorporated. The surface of this groove on the side nearer the pouring lip 3 is vertical or substantially vertical, such that the edge of the groove forms a subsidiary lip 4 that is formed in as sharp a manner as possible.

Figure 2:
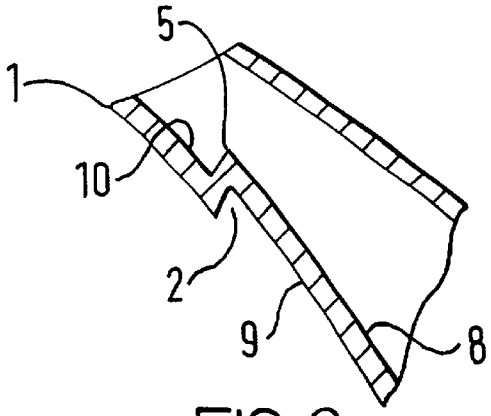
FIG. 2 is a cross sectional view of a spout embodying the invention.

FIG. 2 shows the cross section of the spout along the vertical centreline. The internal surface of the spout at the position of the groove or notch 2 exhibits the raised portion or fence 5, being an inner protrusion.

Figure 3:
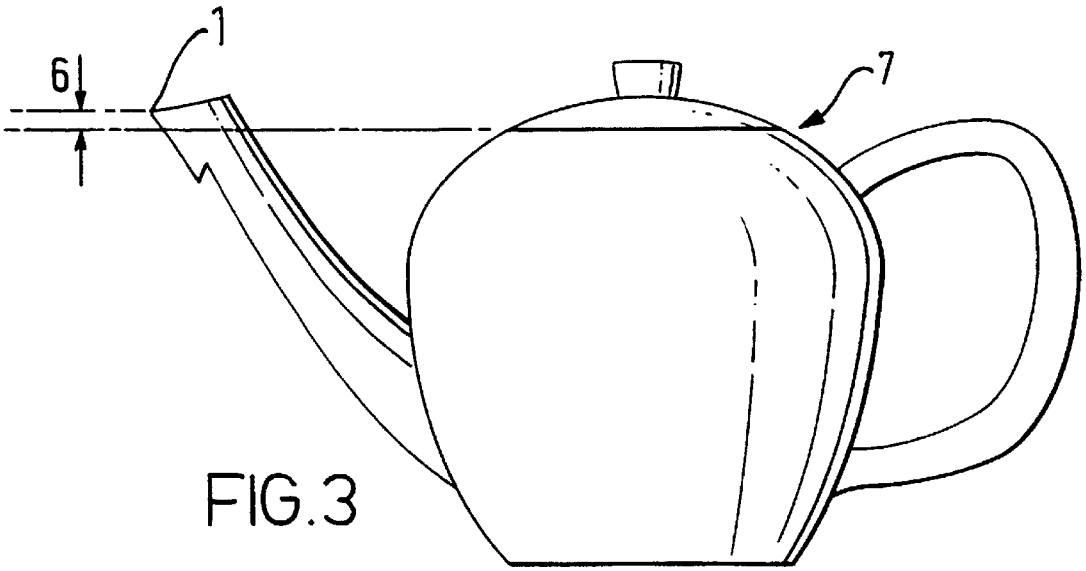
FIG. 3 is a side view of a teapot with the spout of FIGS. 1 and 2 embodying the invention.

FIG. 3 shows the invention incorporated into a teapot. This illustrates a preferred embodiment of the invention that includes the edge of the spout 1 raised above the maximum level 7 of the fluid in the teapot, in this instance denoted by the fluid overflowing over the lid aperture. This rise 6 of at least 5 mm will achieve significant benefits in pouring and reduced surge. A smaller rise may also be incorporated but the benefits will be reduced accordingly.

Figure 4:
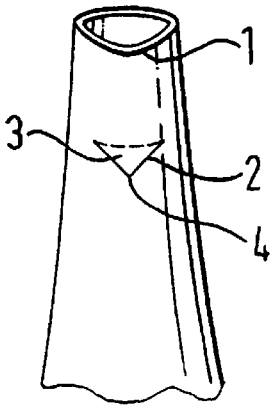
FIG. 4 is a front view of a spout embodying the invention.

FIG. 4 shows a front elevation of the spout showing the front elevation of the subsidiary lip 4, the pouring lip 1 and the location of the transverse groove 2. The substantially vertical surface of the groove nearer the pouring lip is hidden from direct view but is indicated on the figure.

The operation of the embodiment of the invention is as follows when pouring a liquid through the spout or lip, the liquid passes over the inner protrusion in the form of the ridge or fence. In the embodiment shown, the protrusion causes a constriction and so the speed of the flow in this area is increased. When tilting the vessel and spout back to its usual position after pouring, the flow is cutoff by the protrusion before the pouring lip so that the risk of drips occurring at the pouring lip is reduced.

In the event that any drips do form at the pouring lip, these will flow along the outer surface as far as the outer protrusion, but at the outer protrusion the drips will either fall into the vessel to which liquid is poured or the last drop will remain attached, and therefore not wetting the surface below the protrusion, or any surfaces under where pouring occurs such as a table on which the teapot may stand, because of the pointed nature of the protrusion giving a large surface area.

In the preferred embodiment the dimensions of the spout should be approximately equal to those now discussed. With reference to FIGS. 1 and 2, the smallest diameter of the spout; that is the diameter of the spout at the constriction 5, should be in the order of 8 mm. The inner diameter of the spout at the pouring lip 1 should be approximately 13 mm. The height of the internal protrusion, that is the height difference between inner surfaces 8 and 10, should be in the order of 5 mm. In the preferred embodiment the protrusion is angular but it may not be necessary in all embodiments of the spout.

The outer protrusion should be angular with a sharp point and should protrude from the outer surface 9 by approximately 7 mm.

The distance between the pouring lip 1 and the outer protrusion 4 should be in the order of 13 mm. The distance from pouring lip 1 to the inner protrusion, that is the length of surface 10, should be approximately 10 mm.

With reference to FIG. 3 the height of the pouring lip 1 above the maximum level of fluid in the vessel 7 (i.e. dimension 6) should be in the order 5 mm to prevent surges of liquid when the liquid is first poured from the vessel.

The preferred embodiment of the present invention can be made from most materials but ceramics provide better mans of manufacture and ease of clearing the final product. Other materials that are suitable include metals, rubber and blow moulded plastics.

It was found that the teapot embodiment of the present invention could be made using earthenware slip clay moulded in a 4 piece plaster of Paris mould. When the product was suitably dry (leather hard) it can be bisque fired at 1000° C., this causes the product to shrink by approximately 20%. The firing at this stages takes roughly 8 hours. Glazing of the product can take place once it has bee removed from the firing kiln and allowed to cool. The product is re-fired at 1060° C. after two coats of glaze have been applied.

In another embodiment of the present invention an attachment that can be attached to conventional spouts to prevent dripping is envisaged. The attachment may take the form of a spout or collar fitted over the existing spout with the features to prevent dripping as described earlier incorporated on the adjunct collar.

Another embodiment of the attachment may take the form of a piece of suitable material shaped similar to the other protrusion described above. A means to attach this embodiment to the spout may incorporate a suitable cement and/or a clip made from suitable material that fastens the attachment to the spout by fitting around the spout or over the pouring lip.

What is claimed:

1. A spout or lip for pouring liquid having an inner surface and an outer surface, terminating in a pouring lip, the inner surface being suitable for pouring a liquid, the outer surface having an outer protrusion comprising a step in the outer surface and so arranged that a liquid flowing from the pouring lip along the outer surface does not pass beyond the outer protrusion, the inner surface having an inner protrusion arranged to terminate the liquid flow when tilting the spout or lip after pouring a liquid.

2. A spout or lip for pouring liquid having an inner surface and an outer surface, terminating in a pouring lip, the inner surface being suitable for pouring a liquid, the outer surface having an outer protrusion defining a transverse groove or notch and so arranged that a liquid flowing from the pouring lip along the outer surface does not pass beyond the outer protrusion, the inner surface having an inner protrusion arranged to terminate the liquid flow when tilting the spout or lip after pouring a liquid.

3. A spout or lip for pouring liquid according to claim 2 or 1, wherein the outer protrusion has a substantially downward facing point.

4. A spout or lip for pouring liquid according to claim 2 or 1, wherein the outer protrusion is positioned substantially near the pouring lip.

5. A spout or lip according to claim 2 or 1 further comprising means to removably attach said spout or lip to a vessel as a separate component.

6. A spout or lip according to claim 1, wherein the inner protrusion and the outer protrusion comprise a single step in the inner and outer surfaces.

7. A spout or lip for pouring a liquid having an inner surface and an outer surface terminating in a pouring lip, the outer surface having an outer protrusion so arranged that a liquid flowing on the outer surface forms a drop on the protrusion and does not pass beyond the protrusion, the inner surface being suitable for pouring a liquid and having an inner protrusion protruding therefrom so arranged to terminate liquid flow when tilting the spout or lip after pouring a liquid, wherein the inner protrusion on the inner surface comprises an edge and wherein the outer protrusion and the inner protrusion comprise a single step in the inner and outer surfaces.

8. A spout or lip for pouring liquid having an inner surface and an outer surface terminating in a pouring lip, the outer surface having an outer protrusion so arranged that a liquid flowing on the outer surface forms a drop on the protrusion and does not pass beyond the protrusion, the inner surface being suitable for pouring a liquid and having an inner protrusion protruding therefrom so arranged to terminate liquid flow when tilting the spout or lip after pouring a liquid, wherein the inner protrusion on the inner surface comprises an edge and wherein the outer protrusion defines a groove in the outer surface.

9. A vessel incorporating a spout or lip according to claim 2, 1, 7 or 8.

10. A vessel according to claim 9, wherein the vessel is a teapot.

11. A vessel according to claim 9, wherein the maximum liquid level in the vessel is approximately 5 mm below the pouring lip when the vessel is placed on a substantially horizontal surface.

12. A non-drip attachment for a spout or lip of a pouring vessel comprising means for attaching the non-drip attachment to a spout and an outer protrusion defining a transverse groove or notch disposed in relation to the attachment such that in use the protrusion is disposed on an under side of the spout and arranged so that a liquid flowing from the pouring lip of the spout along an outer surface thereof does not pass beyond the outward protrusion; and wherein the attachment has an inner surface having an inner protrusion arranged to terminate the liquid flow when tilting the spout or lip after pouring a liquid.

13. A non-drip attachment for a spout or lip of a pouring vessel comprising means for attaching the non-drip attachment to a spout and an outer protrusion comprising a step in the outer surface disposed in relation to the attachment such that in use the protrusion is disposed on an under side of the spout and arranged so that a liquid flowing from the pouring lip of the spout along an outer surface thereof does not pass beyond the outward protrusion; and wherein the attachment has an inner surface having an inner protrusion arranged to terminate the liquid flow when tilting the spout or lip after pouring a liquid.

14. A non-drip attachment according to claim 12 or 13, wherein the attachment is a collar fitting over the spout.

15. A non-drip attachment according to claim 12 or 13 wherein the attachment is a collar fitting inside the spout.

16. A non-drip attachment according to claim 14, wherein the collar is attached to the spout by a clip that fits over the existing spout.

17. A non-drip attachment according to claim 14, wherein the collar is attached to the spout by using a suitable cement.

18. A non-drip attachment according to claim 15, wherein the collar is attached to the spout by a clip that fits over the existing spout.

19. A non-drip attachment according to claim 15, wherein the collar is attached to the spout by using a suitable cement.

* * * * *